US010328298B2

(12) United States Patent
VanHorn et al.

(10) Patent No.: US 10,328,298 B2
(45) Date of Patent: Jun. 25, 2019

(54) CHAIR-BASED WORKOUT APPARATUS AND METHODS

(71) Applicant: FTD Industries, Peyton, CO (US)

(72) Inventors: Craig A. VanHorn, Castle Pines, CO (US); Kyle J. VanHorn, Peyton, CO (US)

(73) Assignee: FTD Industries, Peyton, CO (US)

( * ) Notice: Subject to any disclaimer, the term of this patent is extended or adjusted under 35 U.S.C. 154(b) by 30 days.

(21) Appl. No.: 15/711,820

(22) Filed: Sep. 21, 2017

(65) Prior Publication Data

US 2018/0008860 A1 Jan. 11, 2018

Related U.S. Application Data

(63) Continuation-in-part of application No. 14/704,173, filed on May 5, 2015, now Pat. No. 9,795,820.
(Continued)

(51) Int. Cl.
*A63B 21/16* (2006.01)
*A63B 21/00* (2006.01)
(Continued)

(52) U.S. Cl.
CPC ..... *A63B 21/0442* (2013.01); *A63B 21/0552* (2013.01); *A63B 21/0557* (2013.01); *A63B 21/154* (2013.01); *A63B 21/156* (2013.01); *A63B 21/1609* (2015.10); *A63B 21/4035* (2015.10); *A63B 23/1209* (2013.01); *A63B 21/068* (2013.01); *A63B 21/0628* (2015.10); *A63B 21/151* (2013.01); *A63B 21/159* (2013.01); *A63B 21/16* (2013.01); *A63B 21/4034* (2015.10); *A63B 23/0405* (2013.01); *A63B 23/1227* (2013.01); *A63B 23/1254* (2013.01); *A63B 23/1281* (2013.01);
(Continued)

(58) Field of Classification Search
CPC . A63B 21/04; A63B 21/0421; A63B 21/0428; A63B 21/0435; A63B 21/0442; A63B 21/1609; A63B 21/154; A63B 21/16
USPC ..... 482/121–139
See application file for complete search history.

(56) References Cited

U.S. PATENT DOCUMENTS 4,921,247 A * 5/1990 Sterling ..... A63B 17/00 482/130
5,080,353 A * 1/1992 Tench ..... A63B 21/154 482/130

(Continued)

OTHER PUBLICATIONS

U.S. Appl. No. 14/704,173, NonFinal Office Action dated Aug. 22, 2016, 8 pages.

(Continued)

*Primary Examiner* — Andrew S Lo
(74) *Attorney, Agent, or Firm* — Adsero IP

(57) ABSTRACT

A workout system is provided that includes a piece of furniture having at least a backrest and a seat. A chair workout machine is provided coupled to the piece of furniture. The chair workout machine includes a support frame coupled to at least one structure of the piece of furniture. At least one rotatable arm is rotatably attached to the support frame. One or more resistance elements are coupled to the at least one rotatable arm, where the resistance elements arranged to provide resistance to movement by at least one body part of a user.

18 Claims, 12 Drawing Sheets

Related U.S. Application Data

(60) Provisional application No. 61/989,367, filed on May 6, 2014.

(51) Int. Cl.

| | |
|---|---|
| ***A63B 21/04*** | (2006.01) |
| ***A63B 21/055*** | (2006.01) |
| ***A63B 23/12*** | (2006.01) |
| *A63B 21/068* | (2006.01) |
| *A63B 23/04* | (2006.01) |
| *A63B 21/062* | (2006.01) |

(52) U.S. Cl.

CPC ... *A63B 2208/0233* (2013.01); *A63B 2209/10* (2013.01); *A63B 2210/02* (2013.01); *A63B 2210/50* (2013.01); *A63B 2225/09* (2013.01)

(56) References Cited

U.S. PATENT DOCUMENTS 5,090,694 A * 2/1992 Pauls ..... A63B 21/015 482/118
5,171,295 A * 12/1992 Schwalm, Jr. ..... A63B 21/154 482/131
5,234,394 A * 8/1993 Wilkinson ..... A63B 21/055 482/121
5,362,296 A * 11/1994 Wang ..... A63B 21/04 482/121
5,527,245 A * 6/1996 Dalebout ..... A63B 21/00072 482/103
5,569,138 A * 10/1996 Wang ..... A63B 21/015 482/120
5,674,167 A * 10/1997 Piaget ..... A63B 21/0552 482/130
5,906,566 A * 5/1999 Whitcomb ..... A63B 21/0552 482/130
5,984,844 A * 11/1999 Royer ..... A63B 21/0552 482/121
6,099,445 A * 8/2000 Rovinsky ..... A63B 21/0552 482/121
6,599,223 B2 * 7/2003 Wang ..... A63B 21/005 482/138
6,712,740 B2 * 3/2004 Simonson ..... A63B 21/154 482/102
7,128,700 B2 * 10/2006 Wallach ..... A63B 21/0552 482/121
7,137,935 B2 * 11/2006 Clarke ..... A63B 21/00043 482/121
D533,910 S * 12/2006 Dibble ..... D21/676
7,250,021 B2 * 7/2007 Leight ..... A63B 21/025 482/116
7,344,484 B1 * 3/2008 Porcellato ..... A47C 7/62 482/123
7,775,949 B2 * 8/2010 Bowser ..... A63B 21/00043 482/121
9,795,820 B2 10/2017 VanHorn et al.
2003/0087737 A1 * 5/2003 Studdard ..... A63B 21/02 482/142
2004/0053756 A1 * 3/2004 Tremayne ..... A63B 21/055 482/126
2009/0017999 A1 * 1/2009 Halbridge ..... A63B 21/026 482/130
2009/0209397 A1 * 8/2009 Miskech ..... A63B 21/00181 482/140
2010/0255965 A1 * 10/2010 Chen ..... A63B 21/0552 482/130
2014/0274599 A1 * 9/2014 Chuang ..... A63B 21/0552 482/115
2015/0321049 A1 11/2015 VanHorn et al.

OTHER PUBLICATIONS

U.S. Appl. No. 14/704,173, Final Office Action dated Jan. 27, 2017, 13 pages.
U.S. Appl. No. 14/704,173, Notice of Allowance dated Jun. 21, 2017, 11 pages.

* cited by examiner

400

500

1000

1300

CHAIR-BASED WORKOUT APPARATUS AND METHODS

CROSS-REFERENCES TO RELATED APPLICATIONS

This application is a continuation-in-part of U.S. patent application Ser. No. 14/704,173 filed May 5, 2015 by Craig A. VanHorn et al. and titled, "Chair-Based Workout Apparatus and Methods", which claims priority to U.S. Patent Application Ser. No. 61/989,367 (the "'367 application"), filed May 6, 2014 by Craig A. VanHorn et al. and titled, "Chair-Based Workout Apparatus and Methods" .

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND

Conventional home or office workout systems and equipment are generally standalone devices requiring dedicated floor space. Even equipment that may be folded and stowed away requires dedicated floor space to be used. Available space within the home or office often limits the types of workout equipment, and the types of exercises that may be performed on the workout equipment. Further, many workout systems may each have features that are redundant from one another. For example, multiple pieces of workout equipment may each have a respective seat or bench that cannot be used with other pieces of equipment.

Moreover, workout equipment for resistance training include respective sets of weights or other forms of resistance. For example, a cable-based weight training machines may include a weight stack, each weight stack having a plurality of rectangular plates. The weight stack is only operable with its respectively associated cable-based weight training machine, and limited to the exercises capable of being performed with the particular cable-based weight training machine. Thus, in order to have the ability to perform a wider variety of exercises, additional machines, and weight types are necessary. For example, a bench and free weights may be needed to complement the cable machine. To utilize the bench and free weights, different types of dumbbells, barbells, and weighted plates may be needed. This additionally adds to the bulk and space requirements for a home or office gym setup.

"All-in-one" type adjustable workout equipment may be available, with adjustable weights, adjustable seating and standing positions, as well as the ability to be folded and stowed away. However, in the confines of a small office or room, even these singular pieces of workout equipment require floor space for the adjustable seat, and accompanying form of resistance when used. Moreover, in an office or home setting, the noise caused by the movement of equipment and performance of exercises on the equipment may cause distractions to other people in the immediate vicinity. Therefore, the combination of space requirements and the distraction caused by conventional weight training equipment makes the use of such equipment impractical.

Accordingly, workout equipment that utilizes an existing chair to reduce the space required, and distractions caused, is provided below.

BRIEF SUMMARY

According to a set of embodiments, a system, method, and apparatus for a chair-based workout system is provided.

The tools provided by various embodiments include, without limitation, methods, systems, and apparatuses. Merely by way of example, a method might comprise one or more procedures, any or all of which may be executed by the system or apparatus. Correspondingly, an embodiment might provide a system or apparatus to perform one or more procedures in accordance with methods provided by various other embodiments. Similarly, an apparatus might comprise features that may be implemented as part of a system, and/or to perform such methods.

In one aspect, chair-based workout system includes a piece of furniture having at least a backrest and a seat, and a chair workout machine coupled to the piece of furniture. The chair workout machine includes a support frame coupled to at least one structure of the piece of furniture, at least one rotatable arm rotatably attached to the support frame, and one or more resistance elements coupled to the at least one rotatable arm, the resistance elements arranged to provide resistance to movement by at least one body part of a user.

In one set of embodiments, the piece of furniture may include an office chair, where the support frame of the chair workout machine may couple to the backrest of the office chair. The support frame may include a mounting support frame for coupling to a seatback of the backrest of the office chair. The mounting support frame may include an at least one attachment point for attaching to the seat back. In other embodiments, the office chair may include a seat post, where the support frame includes at least one transverse member having a distal and proximal end, the distal end of the at least one transverse member having a clamp, the clamp coupling the support frame to the seat post of the office chair.

In further embodiments, the support frame further includes a locking plate having at least one set of locking positions for a respective at least one rotatable arm. The at least one rotatable arm may attach to a pivot point of the locking plate, wherein the rotatable arm is operable to rotate around the pivot point. The locking plate may include a locking mechanism to lock the at least one rotatable arm to a locking position of the at least one set of locking positions. The locking plate may further include two pivot plates to which two rotatable arms of the at least one rotatable arm are attached, wherein each of the two rotatable arms are operable to rotate around the pivot point.

In various embodiments, the one or more resistance elements comprise resistance bands extending along at least a portion of the at least one rotatable arm. The workout system may further include at least one user attachment disposed at a distal end of the at least one rotatable arm and operably coupled to the one or more resistance elements. The workout system may further include one or more guiding pulleys, wherein the guiding pulleys interact with the one or more resistance elements to guide movement of the one or more resistance elements by the at least one body part of the user.

In another aspect, a chair-based workout device is provided. The chair based workout device includes a support frame coupled to at least one structure of a piece of furniture, at least one rotatable arm rotatably attached to the support frame, and one or more resistance elements coupled to the at least one rotatable arm, the resistance elements arranged to provide resistance to movement by at least one body part of a user.

In one set of embodiments, the support frame includes a mounting support frame, wherein the mounting support frame is coupled to a seatback of the backrest of the office chair at an at least one attachment point of the support frame. In other embodiments, the support frame includes at least one transverse member having a distal and proximal end, the distal end of the at least one transverse member having a clamp, the clamp coupling the support frame to the seat post of the office chair.

In various embodiments, the workout device may further include at least one user attachment disposed at a distal end of the at least one rotatable arm and operably coupled to the one or more resistance elements. Additionally, the support frame may further include a locking plate having at least one set of locking positions for a respective at least one rotatable arm, wherein the at least one rotatable arm is attached to a pivot point of the locking plate, wherein the rotatable arm is operable to rotate around the pivot point, and wherein the locking plate includes a locking mechanism to lock the at least one rotatable arm to a locking position of the at least one set of locking positions. In further embodiments, the workout device may further include at least one user attachment, the user attachment disposed at a distal end of the at least one rotatable arm and operably coupled to the one or more resistance elements.

In another aspect, a method for utilizing the chair-based workout system is provided. The method includes providing a support frame attachable to at least one structure of a piece of furniture, securing the support frame to the at least one structure of a piece of furniture, providing at least one rotatable arm rotatably attached to the support frame, providing one or more resistance elements coupled to the at least one rotatable arm, and rotating the one or more rotatable arms about a pivot point of the support frame into a position that the one or more resistance elements resist movement by a user.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The accompanying descriptions of FIGS. 1-12 are provided for purposes of illustration and should not be considered to limit the scope of the different embodiments. FIGS. 1-12 may refer to examples of different embodiments corresponding various stages and components of the chair workout machine and system, which can be considered alternatives or which can be used in conjunction with one another in the various embodiments.

Figure 1:
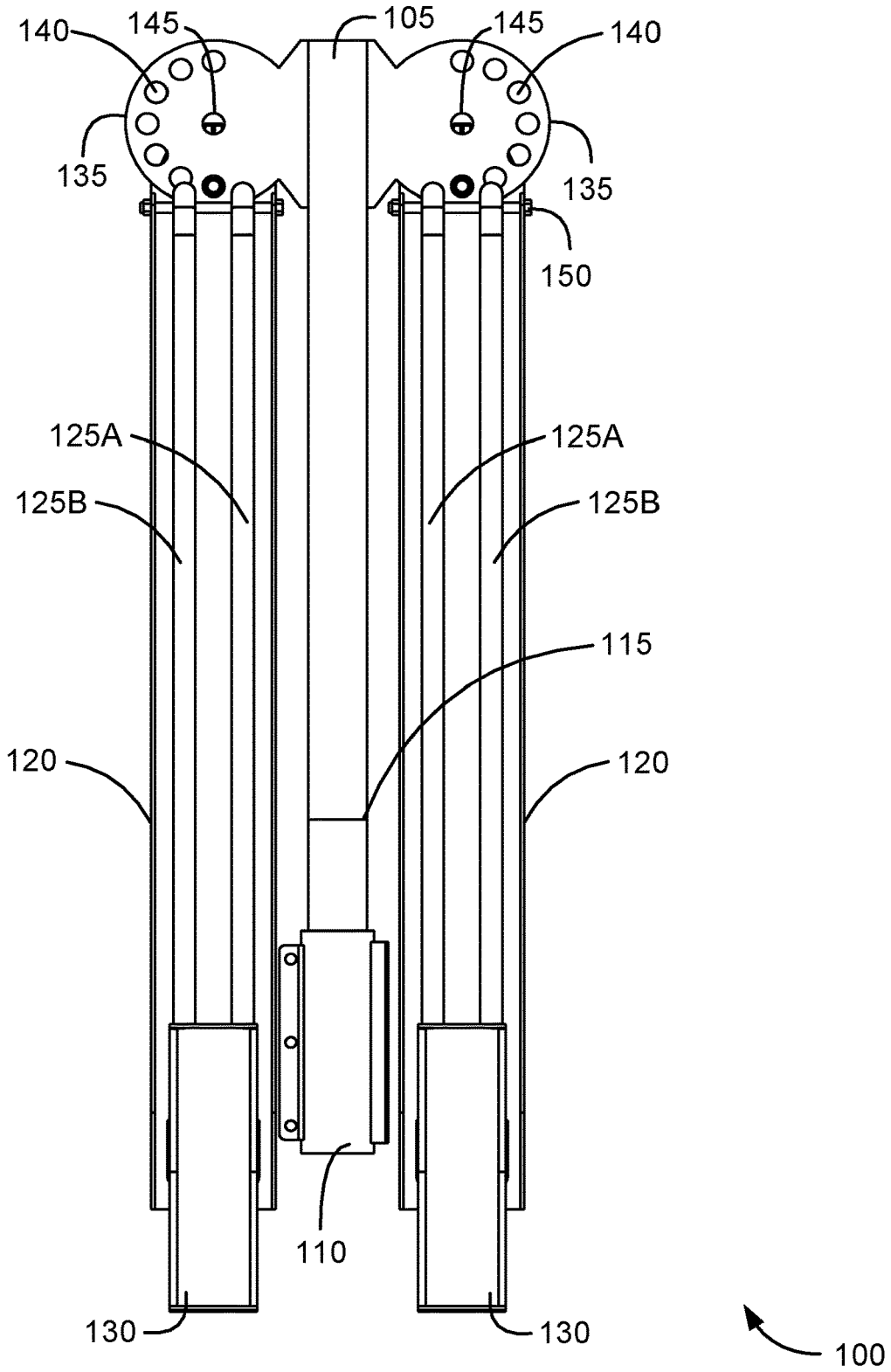
FIG. 1 is a frontal view of a clamp-supported chair workout machine, in accordance with various embodiments.

FIG. 1 provides a front view of a clamp-supported chair workout machine 100, in accordance with various embodiments. According to one set of embodiments, the clamp-supported chair workout machine 100 may be adapted to attach to furniture, such as various types of seating and chairs. Suitable furniture may include, but is not limited to, office chairs, recliners, single-seater sofas, rocking chairs, armchairs, stools, and the like. In various embodiments, the clamp-supported chair workout machine 100 includes a main support frame 105. The main support frame 105 may have an L-shape, where a vertical member is coupled substantially orthogonal to a transverse member. In some embodiments, the main support frame 105 may be formed as a single continuous structure. In other embodiments, the vertical and transverse members may be two separate structures joined at joint 115. Thus, in some embodiments, one or both of the transverse member and vertical member may exhibit a curve, forming at least partially an L-shape. In various embodiments, the joint 115 may include a spring loaded hinge that allows the vertical member to flex backwards.

The main support frame 105 may include a clamp 110 coupled to the distal end of the transverse member. The clamp 110 may securely couple the main support frame 105 one or more structures of a piece of furniture. In various embodiments, the clamp 110 may couple to, without limitation, a chair base, a main seat post coupling the seat of a chair to the chair base, one or more legs of a chair, an armrest, a seat, a headrest, a headrest support post attaching the headrest to the backrest, a backrest support post attaching the backrest to the seat, or the backrest itself. In some embodiments, a single clamp 110 may be used. In other embodiments, multiple clamps 110 may be used. For example, in some embodiments, the transverse member may branch into more than one distal end, each distal end coupled to a separate clamp 110. Thusly, each separate clamp 110 may attach to different parts of the furniture. In various embodiments, different types of clamps 110 may be utilized. The types of clamps 110 may include, without limitation, collar clamps, vice clamps, claw-type clamps, C-clamps, O-clamps, strap clamps, screw clamps, clips, shaft collars, and the like. In one set of embodiments, a collar clamp 110 may be used to secure the main support frame 105 to the main seat post of an office chair. The collar clamp 110 may be fastened with standard fasteners, or with an ergonomic quick release mechanism.

The main seat post may couple the seat of the office chair to a wheeled, rotatable chair base. The main seat post may further be operable as a hydraulic or pneumatic cylinder of the office chair, allowing the seat to be raised or lowered relative to the chair base. In further embodiments, the length of the transverse member or vertical member may be adjustable to adapt to the particular piece of furniture it is adapted to. The transverse member may be positioned below the seat, extending from the clamp 110 coupled to main seat post of the chair, traversing the underside of the seat to the backrest of the office chair. The main support frame 105 may then curve around the backrest allowing the vertical member of the member to extend along the length of the backrest. The length of the vertical member may again be adjustable to adapt to the length of the backrest. In various embodiments, the surfaces of the main support bar 105 facing the seatback of the backrest, and underside of the seat, may be padded to reduce friction and wear between the furniture and main support frame 105. The main support frame 105 may deflect with the reclining of the backrest of the office chair so that it does not impair normal operating functions of the chair. In further embodiments, the vertical member of the main support frame 105 may utilize a backrest attachment, such as, without limitation, nylon straps with buckles to fasten the vertical member to the backrest. The nylon straps may wrap around the backrest in either a latitudinal and longitudinal orientation. The backrest attachment may have adjustable features to conform to a variety of backrest designs.

Two pivoting rotatable arms 120 may be coupled to the main support frame 105 via a locking plate 135. In various embodiments, the locking plate 135 may be secured to the main support frame 105, and the two rotatable arms 120 rotatably coupled to the locking plate 135 at respective pivot points 145. The locking plate 135 may serve as a pivoting hub as well as position locking plates. In some embodiments, the rotatable arms 120 may couple to the position locking plates on either side of the locking plate 135. In other embodiments, the locking plate 135 may instead be formed as two separate position locking plates, each of which may independently secure to the main support frame 105. In various embodiments, the rotatable arms 120 may be operable to rotate around, and lock into different locking positions 140 respectively along either side of locking plate 135. As depicted in the following embodiments, a pair of rotatable arms 120 is utilized for illustrative purposes only. It will be appreciated by those skilled in the art that the number of rotatable arms 120 is not limited to two, and that in other embodiments, one or more rotatable arms 120 may be provided.

According to one set of embodiments, the rotatable arms 120 may each respectively include housing. The housing may include, without limitation, an outer side wall, inner side wall, a back plate, and front plate. The housing may provide protection to and contain various moving parts and resistance elements. Moving parts may include, without limitation, pulleys, gears, levers, belts, cables, and the like. Resistance elements may include various types of elastic bands, resistance bands, cords, bungee cords, rubber tubing, ropes, straps, and the like. In other embodiments, resistance elements may include weight plates. In yet further embodiments, no separate resistance element may be utilized within the housing, and instead a system of cables, pulleys, and other parts may be configured to allow the user to utilize their own bodyweight as resistance. In one set of embodiments, the rotatable arms 120 may each respectively include an inner resistance band 125A and outer resistance band 125B (collectively "resistance bands").

The resistance bands 125A, 125B (collectively 125) may be secured respectively to the proximal ends of the rotatable arms 120 via anchoring pins 150. In various embodiments, each resistance band 125 may include, at a proximal end, a closed loop through which anchoring pin 150 may be passed through. The anchoring pin may then be secured to the housing of the rotatable arm 120, for example, to the inner and outer side walls. The resistance bands 125 may extend down the length of rotatable arms 120 to a guiding pulley (not shown), or other moving part at the distal end of the rotatable arms 120. In various embodiments, each of the inner resistance band 125A and outer resistance band 125B may each be coupled to a respective pulley, gear, or other moving part. The distal ends of the resistance bands may then terminate in a connection to a user attachment 130 with which a person may actuate the resistance bands 125 in performing a workout. The user attachments may include, without limitation, various handles, straps, or leg wraps that can be clipped, or otherwise attached to, with carabiners, or other quick release mechanisms, to the distal end of the resistance bands 125. In embodiments employing resistance bands 125, the resistance provided by the resistance bands 125 may be adjusted by a user by changing which band, and the number of resistance bands that are attached to the handle. For example, in some embodiments, the load provided by the resistance bands may be adjustable from approximately zero pounds up to two hundred pounds per arm. In other embodiments, a higher load may be provided by higher load resistance bands, dependent upon the nature of the furniture to which the main support frame 105 is attached.

In various embodiments, each of the rotatable arms 120 may rotate about pivot point 145 of the locking plate 135, and lock into locking positions 140. The rotatable arms 120 may rotate independently of each other, and lock into different locking positions 140. In various embodiments, the locking positions 140 may be notches in the locking plate 135. The rotatable arms 120 may be held in a locking position 140 by a locking mechanism (not shown). The locking mechanism may include, without limitation, a pull pin, retractable spring plunger, spring loaded pin, screw, bolt, or other locking mechanism. In some embodiments, the locking plate 135 may have locking positions 140 at approximately 30 degree increments. Each locking mechanism for rotatable arms 120 may be attached to a respective proximal end of each rotatable arm 120. In some aspects, the rotatable arms 120 may change positions to encompass or enable the user to perform multiple exercises.

Thus, with the variations in rotatable arm position 120, user attachments 130, and resistance elements, the clamp supported workout machine 100 may be used to perform a number of exercises, including without limitation, the following: When the arms are clocked in the lower position, e.g. approximately five o'clock to seven o'clock positions on the locking plate 135; bicep curls, leg extensions, leg curls, shoulder press, shoulder shrugs, shoulder raises, etc. can be performed. When the arms are extended horizontally, e.g. approximately two o'clock to four o'clock and eight o'clock to ten o'clock; butterflies, bench press, incline press, decline press, reverse flies, back rows, etc. can be performed. When the arms are clocked in the upper position, approximately eleven o'clock to one o'clock; tricep extensions, crunches, decline bench press, etc. can be performed. In further embodiments, the user attachments 130 may be clipped into a position on the rotatable arms 120 for storage. In the stowed position, the workout machine 100 may maintain a low profile to avoid interfering with everyday use of the furniture.

Figure 2:
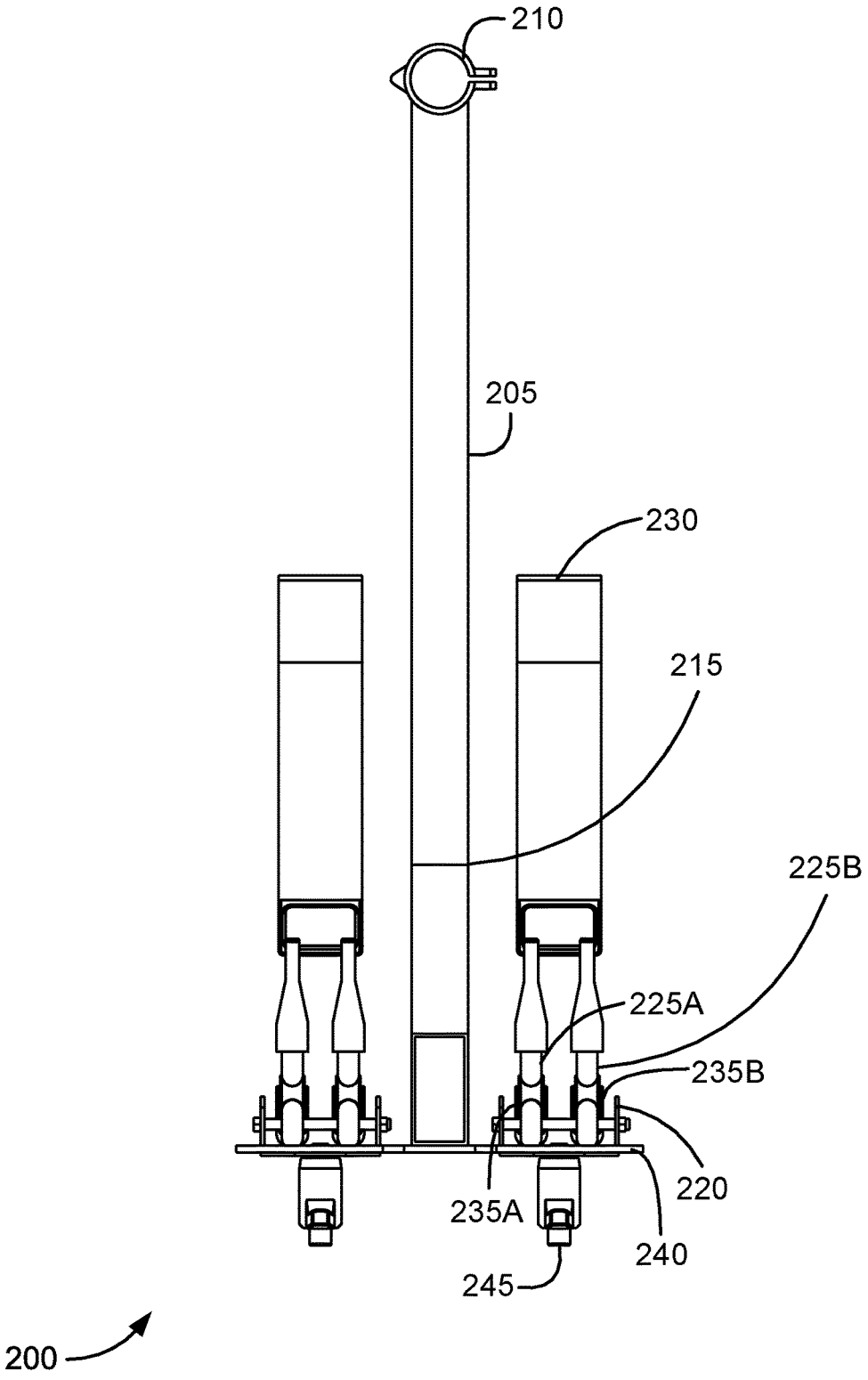
FIG. 2 is an overhead view of a clamp-supported chair workout machine, in accordance with various embodiments.

FIG. 2 depicts a top view of a clamp-supported chair workout machine 200 according to various embodiments. The transverse member of the L-shaped main support frame 205 is visible coupled to a collar clamp 210 at a distal end of the transverse member. In some embodiments, the main support frame 205 may be a single continuous structure. In other embodiments, the main support frame 205 may be extendible. For example, in one set of embodiments, the transverse member of the main support frame 205 may include an outer layer and inner layer. The inner layer may be configured to slide into the outer layer at a proximal end of the outer layer 215. Thus, the outer layer of the transverse member may extend outwards to adjust the length of the transverse member. The outer layer may then be locked against the inner layer at a desired length.

As described above with respect to FIG. 1, each of the rotatable arms 220 may include an inner resistance band 225A and outer resistance band 225B. In various embodiments, an anchoring pin may secure the resistance bands 225A, 225B (collectively 225) to the housing of the rotatable arm 220 at a proximal end of the rotatable arm 220. The inner resistance band 225A may extend to an inner guiding pulley 235A, and outer resistance band 225B may extend to outer guiding pulley 235B (collectively "guiding pulleys"). In various embodiments, the guiding pulleys 235A, 235B (collectively 235) may further function as pivot points for each of the resistance bands 225 respectively. The resistance bands 225 are coupled to user attachments 230 at their distal ends. The resistance bands may be coupled to the user attachment 230 by, without limitation, such as carabiners, clips, hooks, or other types of quick release mechanisms.

Each of the rotatable arms 220 is coupled to main support frame 205 via locking plate 240. The rotatable arms 220 may be rotatably coupled to locking plate 240 at a respective pivot point of the locking plate 240. The rotatable arms 220 may be operable to rotate about a respective pivot point of the locking plate 240, and locked at a specific locking position. As depicted, the rotatable arms 220 are locked at a six o'clock locking position on the locking plate 240. The rotatable arms 220 are locked to the locking position by a locking mechanism 245. In various embodiments, the locking mechanism may include, without limitation, a pull pin, retractable spring plunger, spring loaded pin, screw, bolt, or other locking mechanism.

Figure 3:
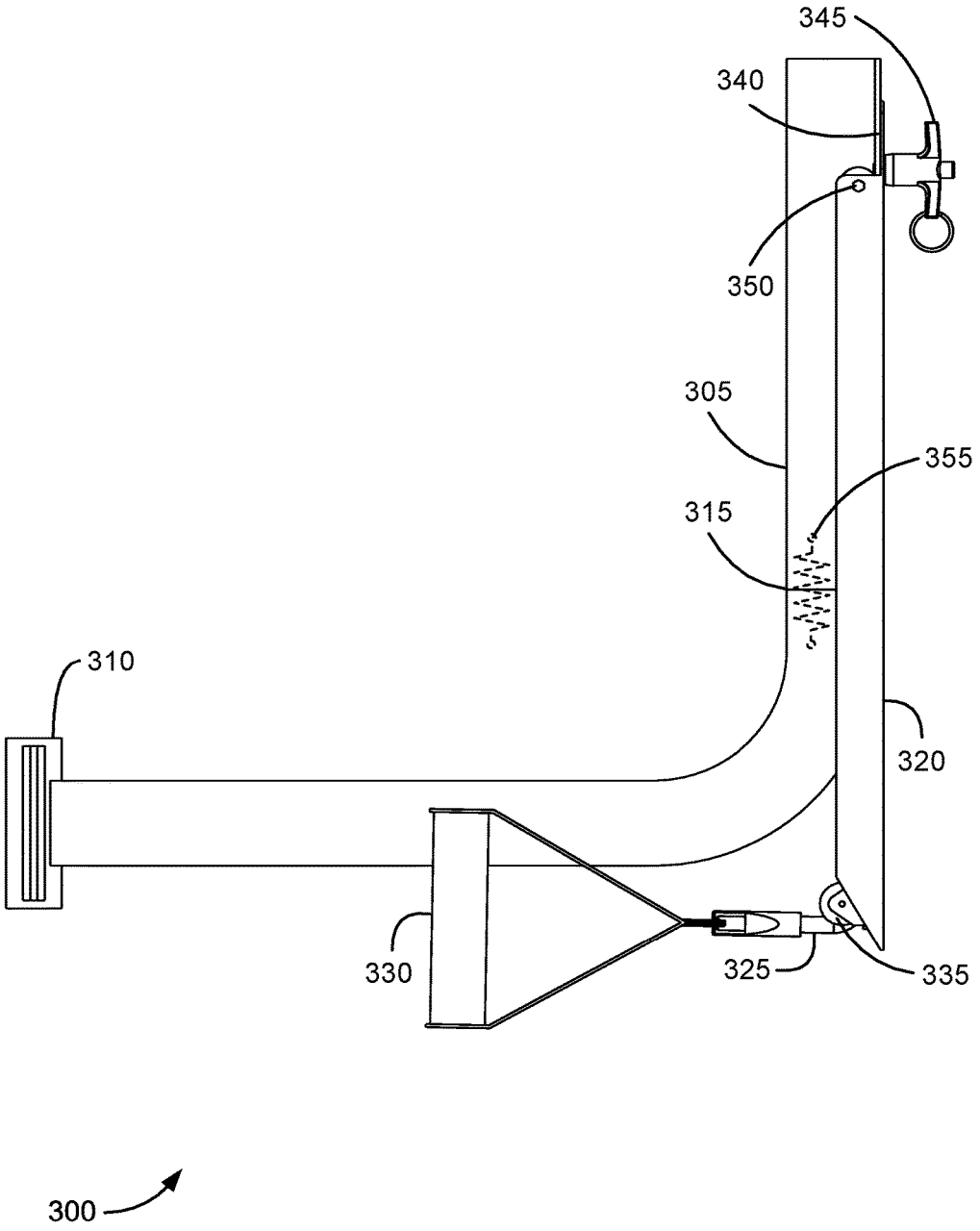
FIG. 3 is a side view of a clamp-supported chair workout machine, in accordance with various embodiments.

FIG. 3 provides a side profile view of the clamp-supported chair workout machine 300. An L-shaped main support frame 305 comprises a vertical member and transverse member. The support frame 305 is coupled to clamp 310 at a distal end of the transverse member. The main support frame 305 may further include a spring loaded hinge 315 having an internal spring 355. The spring may allow the vertical member of the main support frame 305 to flex backwards, deflecting with the reclining of a backrest of the attached furniture so that it does not impair normal operating functions of the furniture. Alternative techniques may be used to allow the vertical member to flex backwards at hinge 315, including, without limitation, using tension bars, or hydraulic or pneumatic pistons within the vertical member of the main support frame 305.

Rotatable arms 320 are coupled to main support frame 305 via locking plate 340. Locking plate 340 is coupled to a distal end of the vertical member, and provides both a pivoting hub and position locking functionality. The rotatable arms 320 may be coupled to a respective pivot point on each side of the locking plate 340. The rotatable arms 340 may be configured to rotate about each pivot point along locking positions in the locking plate 340. Each rotatable arm 320 may be locked in a locking position by locking mechanism 345. In various embodiments, the locking mechanism 345 may be a pull pin, such as a retractable spring plunger, which allows the rotatable arm to be selectively locked into position, or released for movement.

Each rotatable arm 320 may further include resistance bands 325, coupled to a proximal end of the rotatable arm 320 by an anchoring pin 350. Each resistance band 325 may include, at the proximal end, a closed loop through which anchoring pin 350 may be passed through. Anchoring pin 350 may then be secured to the rotatable arm 320 itself. Resistance band 325 may extend to a guiding pulley 335 positioned at the distal end of the rotatable arm 320. In various embodiments, the guiding pulley 335 may help guide the resistance bands 325 down the length of the rotatable arms 320, as well as acting as pivot points for each of the resistance bands 325. The distal end of the resistance band may then be coupled to a user attachment 330. User attachments 330 may include, without limitation, a handle as depicted. The handle may be clipped to the distal end of the resistance band 325 by various means, including, without limitation, carabiners, clips, hooks, sleeve-type quick connectors, and other like quick release mechanisms.

Figure 4:
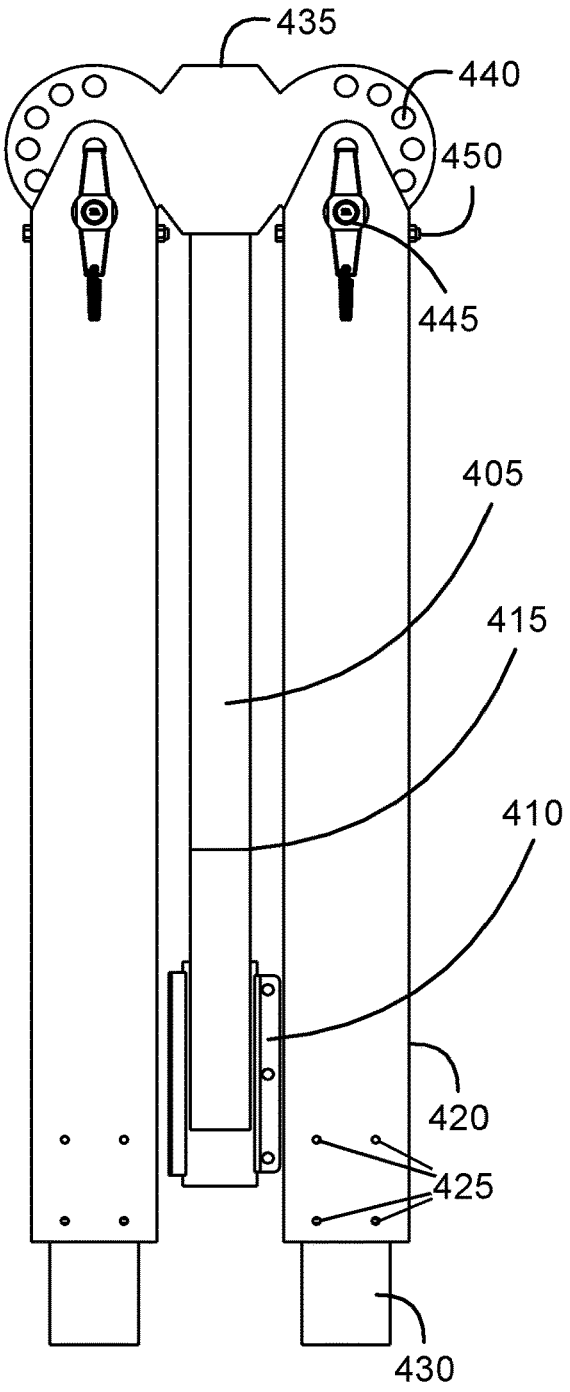
FIG. 4 is a back view of a clamp-supported chair workout machine, in accordance with various embodiments.

FIG. 4 illustrates a rear profile view of the clamp-supported chair workout machine 400, in accordance with various embodiments. In one set of embodiments, the chair workout machine 400 includes an L-shaped main support frame 405. The main support frame 405 may include a vertical member and transverse member. In various embodiments, the vertical member and transverse member may be part of one continuous structure. In other embodiments, the vertical and transverse members may be coupled at joint 415, where the joint 415 may further include a spring loaded hinge that allows the vertical member to flex backwards relative to the transverse member. A clamp 410 may be coupled to a distal end of the transverse member, the clamp 410 operating to secure main support frame 405 to furniture.

A pair of rotatable arms 420 may be coupled to the main support frame 405 via a locking plate 435. As described above, the locking plate 435 may act as both a pivoting hub and position locking plate for the rotatable arms 420. The rotatable arms 420 may be coupled to the locking plate 435 at a respective pivot point on the locking plate 435. The locking plate 435 may in turn be coupled a distal end of the vertical member of the main support frame 405. Each of the rotatable arms 420 may operate to rotate about a respective pivot point, like the hands of a clock. The rotatable arms 420 may be locked into the various locking positions 440 on the locking plate 435 via a respective locking mechanism 445. In some embodiments, the locking mechanism 445 may include, without limitation, a retractable spring plunger. In these embodiments, the locking mechanism 445 may include a button or trigger to cause the retractable spring plunger to retract a plunger of the retractable spring plunger, thereby releasing the retractable arm 420 from the locking position 440 to which it was locked. The retractable arm 420 may then be swung to a different locking position 440 on the locking plate 435. When the button or trigger is released from the retractable spring plunger, the spring loader plunger will advance, allowing the plunger to catch the new locking position 440, locking the rotatable arm 420 to the new locking position 440.

In various embodiments, rotatable arms 420 may include one or more resistance elements. In some embodiments, the resistance elements may include one or more resistance bands. The one or more resistance bands may be secured to a proximal end of a respective rotatable arm 420 via an anchoring pin 450. The resistance bands may include on one end a loop or hook. The anchoring pin 450 may then pass through the loop or hook of the resistance band, and attach to the rotatable arm 420. The resistance bands may then extend from the anchoring pin to a guiding pulley at a distal end of the rotatable arm.

Each guiding pulley may be secured to the rotatable arm 420 at a respective set of pulley attachment points 425. In various embodiments, the rotatable arms 420 may be strengthened or reinforced at pulley attachment points 425 or at points in the proximal end where anchoring pin 450 attaches to the rotatable arm 420. Guiding pulleys may be coupled to pulley attachment points 425 in several ways, including, but not limited to, by screws, bolts, weld, adhesive, anchoring pins, and the like. In various embodiments, pulley attachment points 425 may be located on a back plate of the rotatable arm 420. In other embodiments, the pulley attachment points 425 may be located on any one or combination of structures of the rotatable arm, such as the side plates, front plate, back plate, or end plate. An end plate may include, for example, a cap joining at least two of either of the side plates, front plate, and back plate of a rotatable arm 420. A user attachment 430 may further be coupled to a distal end of the resistance bands.

Figure 5:
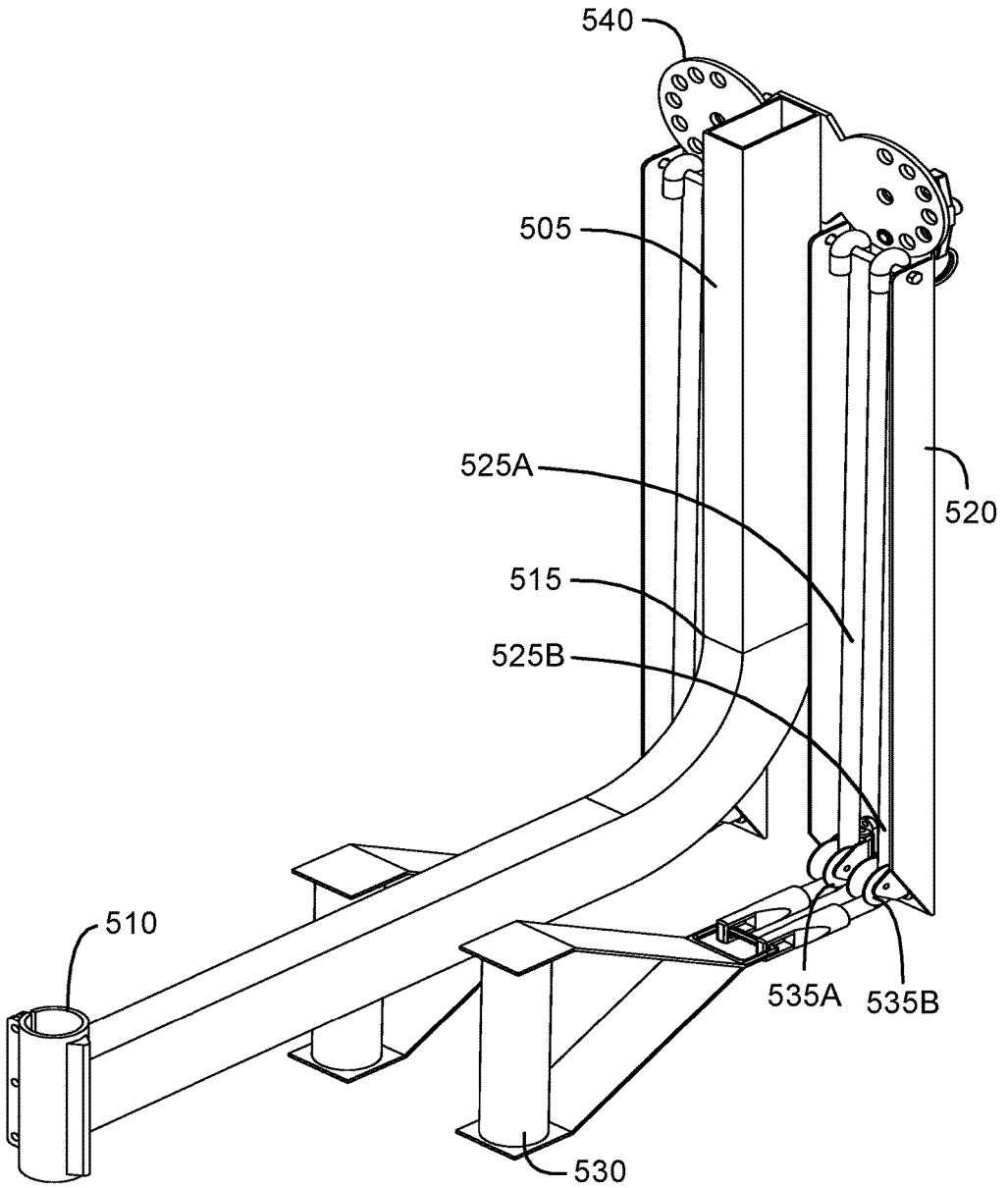
FIG. 5 is a perspective view of a clamp-supported chair workout machine, in accordance with various embodiments.

FIG. 5 illustrates a perspective view of a clamp-supported chair workout machine 500, in accordance with various embodiments. As described above with respect to FIGS. 1-4, the chair workout machine 500 includes an L-shaped main support frame 505. In various embodiments, the main support frame 505 may have a hollow structure. As depicted, in some embodiments, the main support frame 505 may have a hollow rectangular cross-section, having a tube-like structure and a curved elbow. In other embodiments, the elbow may not be curved, but may instead be angled, for example, at a ninety-degree angle. In various other embodiments, the main support frame 505 may be a hollow structure with a different cross-sectional shape. For example, different cross-sectional shapes may include circular, elliptical, or polygonal shapes. In yet further embodiments, the main support frame 505 may be a solid structure without a defined inner cavity.

As described with respect to the previous embodiments, the main support frame 505 may be comprised of a single continuous structure, or formed from two or more separate structures. The main support frame 505 includes both a transverse member, extending outward from the elbow in a transverse direction, and a vertical member, extending from the elbow in a vertical direction. In one set of embodiments, the transverse member and vertical member may be two separate structures coupled together at joint 515. In various embodiments, the transverse member, vertical member, or both members may comprise at least part of the bend of the elbow. In further embodiments, the joint 515 may also include a spring loaded hinge, allowing the vertical member of the main support frame 505 to flex backwards, deflecting with the reclining of a backrest of the attached furniture so that it does not impair normal operating functions of the furniture. In various embodiments, a collar clamp 510 may be provided at a distal end of the transverse member of the main support frame 505. Although a collar clamp 510 has been depicted, it will be appreciated by those having skill in the art, that other clamping or attaching means may be utilized as appropriate to secure to the main support frame 505 to a particular piece of furniture. For example, in other embodiments, the clamp 510 may include, without limitation, vice clamps, claw-type clamps, C-clamps, O-clamps, strap clamps, screw clamps, clips, shaft collars, and the like. In one set of embodiments, a collar clamp 510 may be used to secure the main support frame 505 to the main seat post of an office chair. The collar clamp 510 may be fastened to the main seat post of the office chair with standard fasteners, or with an ergonomic quick release mechanism.

A locking plate 540 may be coupled to the main support frame 505, the locking plate 540 being both a pivoting hub and position locking plate for a pair of rotatable arms 520. In various embodiments, the rotatable arms 520 may be coupled to a respective pivot position around which the rotatable arms 520 may rotate. The locking plates 540 may further include various locking positions to which the rotatable arms 520 may be locked into. As depicted, the rotatable arms are both locked into a six o'clock locking position on their respective sides of the locking plate 540.

In various embodiments, the rotatable arms 520 may include resistance elements. For example, in one set of embodiments, the rotatable arms 520 may include an inner resistance band 525A and outer resistance band 525B (collectively "resistance bands"). The resistance bands 525A, 525B (collectively 525) may extend from a proximal end of a rotatable arm 520, the proximal end being the side of the rotatable arm 520 connected to the locking plate 540, to a distal end of the rotatable arm 520. In various embodiments, the distal end of the rotatable arm 520 may include guiding pulleys 535A, 535B (collectively 535) corresponding to the inner and outer resistance bands. The distal ends of the resistance bands 525 may further be coupled to a respective user attachment 530. In one set of embodiments, the guiding pulleys 535 may be adjustable to move with the movement and positioning of the resistance bands 525, rotatable arms 520, and user attachments 530. For example, depending on the positioning of the user attachment 530 and rotatable arm 520, the guiding pulleys 535 may swivel to allow a greater range of motion.

According to various embodiments, the user attachment 530 may attach to the distal end of one or more resistance bands 525. In one set of embodiments, the user attachment 530, or distal ends of the one or more resistance bands 525 may include a connector. In some embodiments, the connectors may include clips, carabiners, hooks, or other quick release. In other embodiments, the connector may be a separate component to attach the user attachment 530 to the distal ends of the resistance bands 525. In such instances, both the user attachments 530 and distal ends of the resistance bands 525 may have some attachment features to which the connector can couple to. For example, attachment features may include, without limitation, loops, straps, rings, hooks, buckles, and the like. In various embodiments, the rotatable arms 520 may include snapback storage for the various user attachments 530. The snapback storage may be configured to allow the user attachments 530 to lock into a position on the rotatable arm 520 so as not to drag on the ground or hang loosely.

In another aspect, certain sets of embodiments provide a different type of chair workout machine that may be mountable to a backrest of a chair. For example, the chair workout machine may be mounted to a seatback of the backrest of a chair. Various embodiments of the seatback mountable chair workout machine will be described with reference to FIGS. 6-9.

Figure 6:
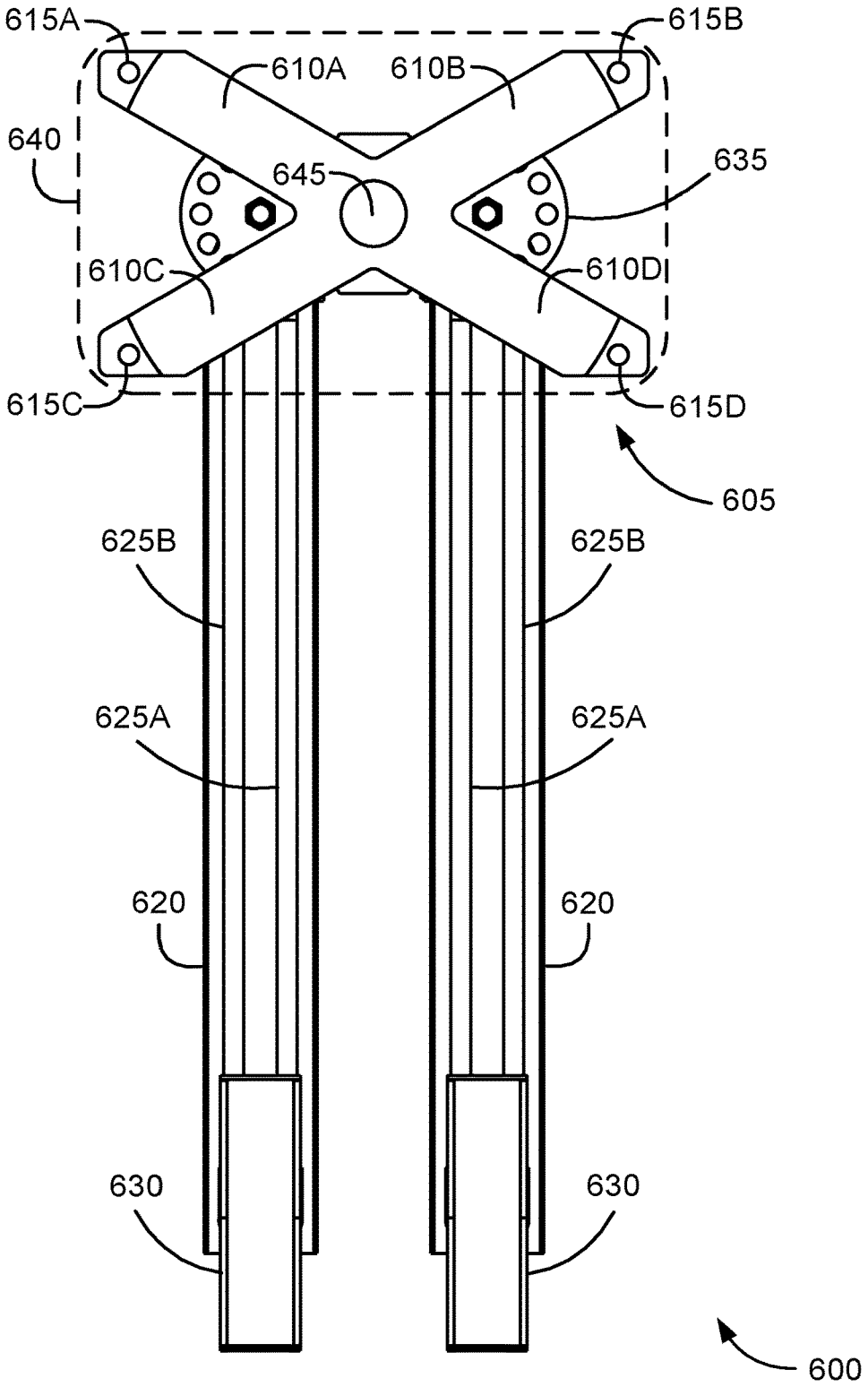
FIG. 6 is a frontal view of a seatback mountable chair workout machine, in accordance with various embodiments.
Figure 7:
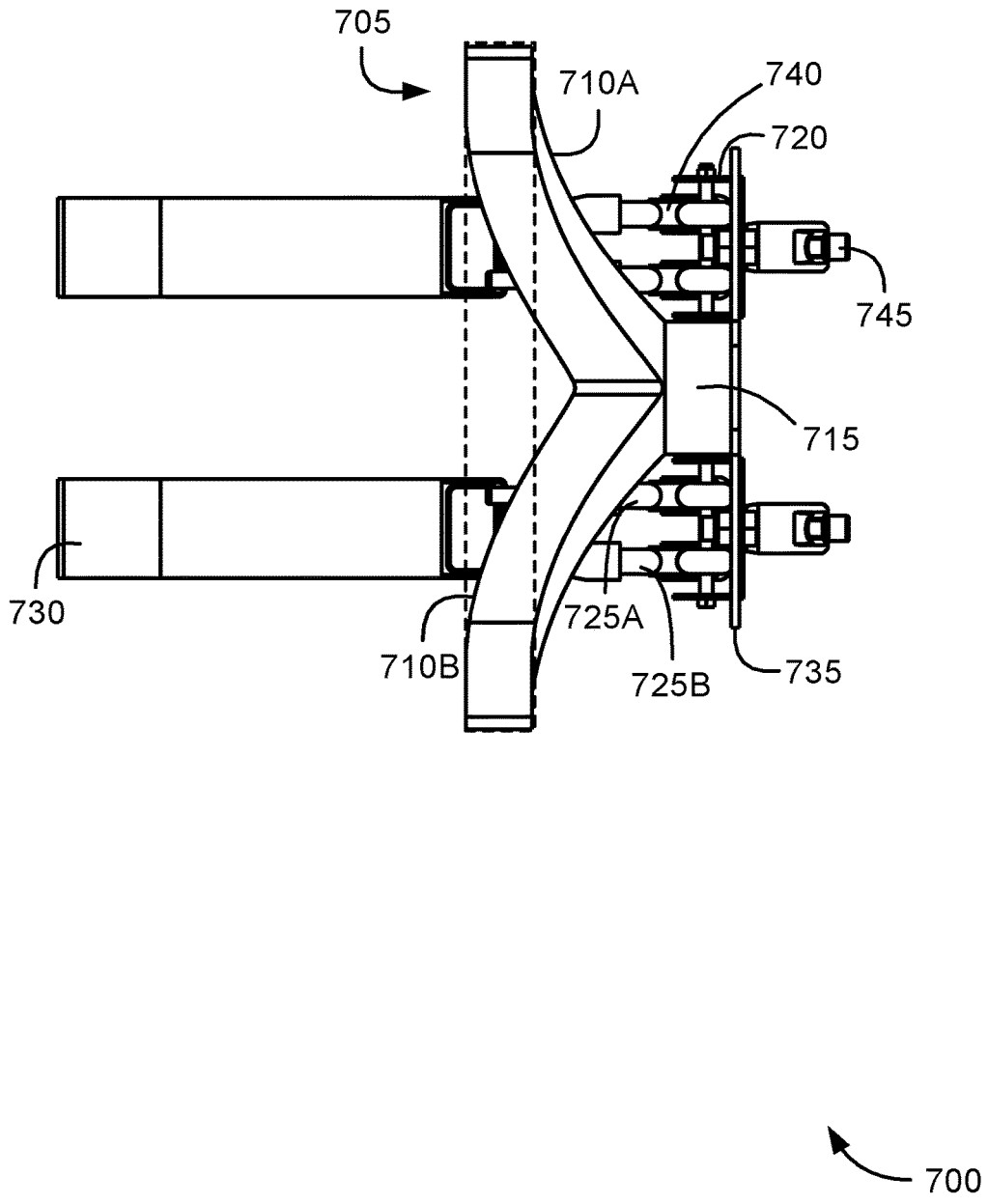
FIG. 7 is a top view of a seatback mountable chair workout machine, in accordance with various embodiments.

A first set of embodiments of the seatback mountable chair workout machine will be described with references to FIGS. 6 & 7, concurrently. FIG. 6 depicts a front view of a seatback mountable chair workout machine 600, in accordance with various embodiments. FIG. 7 depicts a top view of the seatback mountable chair workout machine 700, in accordance with various embodiments. According to one set of embodiments, the seatback mountable chair workout machine 600, 700 may include a mount support frame 605, 705. In various embodiments, the mount support frame 605, 705 may be an X-shaped structure having, when viewed from behind, a top right arm 610A, 710A, top left arm 610B, 710B, bottom right arm 610C, and bottom left arm 610D (collectively the "arms"). Each of the arms 610A, 610B, 610C, 610D (collectively 610) may include respectively an attachment point 615A, 615B, 615C, 615D (collectively 615) at which the arms 610, 710A, 710B may be attached to a seatback or a backrest. In other embodiments, the mount support frame 605, 705 may have a different shape or structure 640 as depicted in phantom lines. For example, the mount structure 640 may include without limitation, plates of various shapes, bars, one or more arms, a claw-like structure, a sleeve, or other suitable shape or structure configured to attach to a seatback or backrest.

In various embodiments, the mount support frame 605, 705 may be coupled to a locking plate 635, 735 via mounting hub 645, 715. In various embodiments, the locking plate 635, 735 may be secured to the mounting hub 645, 715 using fasteners, such as, without limitation, screws, bolts, welding, or other suitable methods of attachment. As in the previously described embodiments, rotatable arms 620, 720 may be attached to respective pivot points of the locking plate 635, 735 via locking mechanism 745. The locking mechanism 745 may include, without limitation, a pull pin, retractable spring plunger, spring loaded pin, screw, bolt, or other locking mechanism. The locking plate 635, 735 may be a pivoting hub as well as a position locking plate for each rotatable arm 620, 720. The locking plate 635, 735 may further include a respective set of locking positions to which each rotatable arm 620, 720 may be secured via the locking mechanism 745.

In various embodiments, the rotatable arms 620, 720 may include resistance bands 625A, 625B, 725A, 725B (collectively 625 and 725 respectively) that extend from a proximal end of the respective rotatable arm 620, 720 to a distal end of the rotatable arm 620, 720. In various embodiments, the distal end of the rotatable arm 620, 720 may further include guiding pulleys 740 corresponding to the inner and outer resistance bands 625, 725. The distal ends of the resistance bands 625, 725 may further couple to a respective user attachment 630, 730. In one set of embodiments, the guiding pulleys 740 may be adjustable to move with the movement and positioning of the resistance bands 625, 725, rotatable arms 620, 720, and user attachments 630, 730. For example, depending on the positioning of the user attachment 630, 730 and rotatable arm 620, 720, the guiding pulleys 740 may swivel to allow a greater range of motion.

According to various embodiments, the user attachment 630, 730 may attach to the distal end of one or more resistance bands 625, 725. In one set of embodiments, the user attachment 630, 730, or distal ends of the one or more resistance bands 625, 725 may include a connector. In some embodiments, the connectors may include clips, carabiners, hooks, or other quick release. In other embodiments, the connector may be a separate component to attach the user attachment 630, 730 to the distal ends of the resistance bands 625, 725. In such instances, both the user attachments 630, 730 and distal ends of the resistance bands 625, 725 may have some attachment features to which the connector can couple to. For example, attachment features may include, without limitation, loops, straps, rings, hooks, buckles, and the like. As described in previous embodiments, the rotatable arms 620, 720 may further include snapback storage for the various user attachments 630. The snapback storage may be configured to allow the user attachments 630 to lock into a position on the rotatable arm 620, 720 so as not to drag on the ground or hang loosely.

Figure 8:
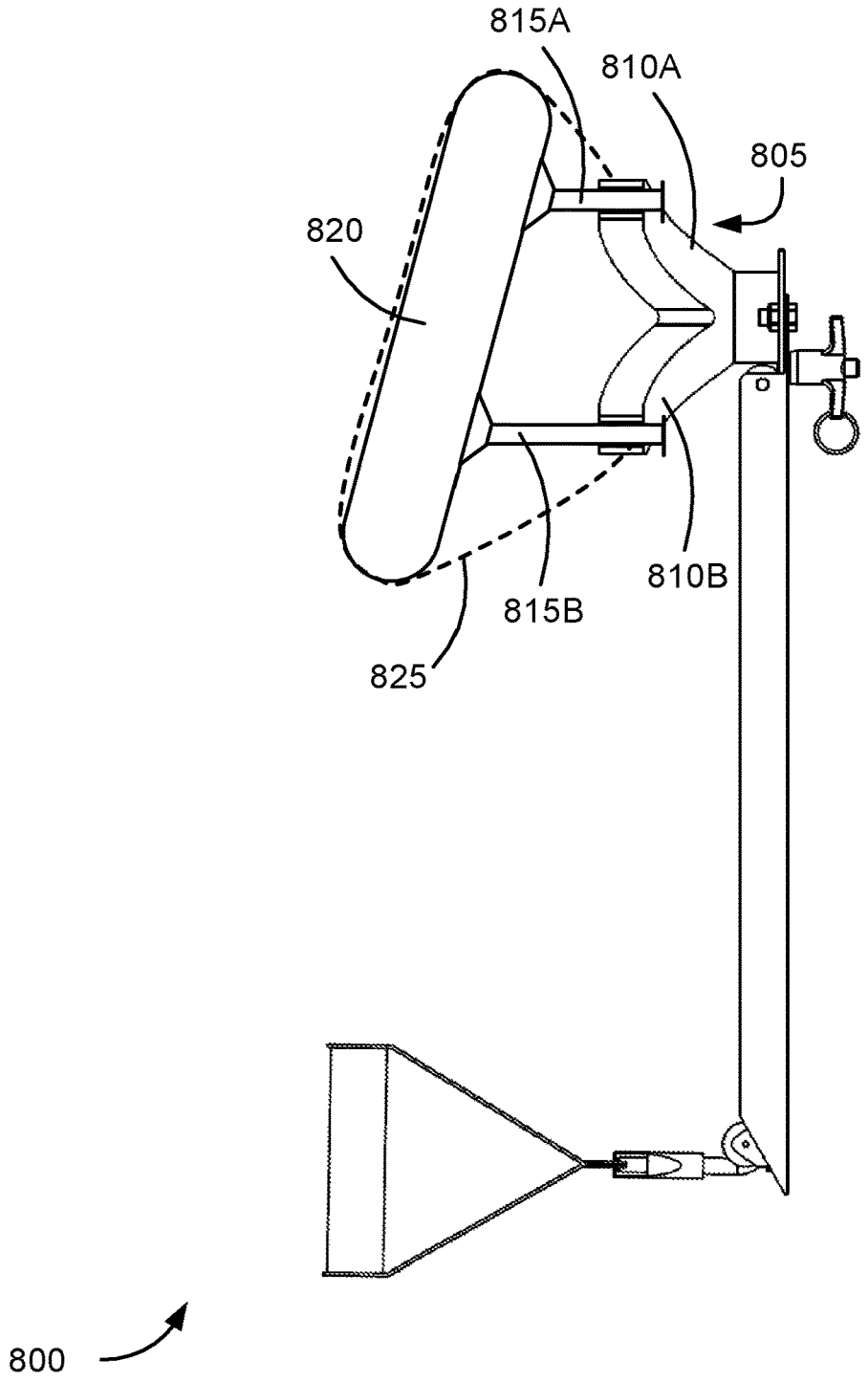
FIG. 8 is a side view of a seatback mountable chair workout machine mounted on a seatback, in accordance with various embodiments.

FIG. 8 is a side view of a seatback mountable chair workout machine 800 as coupled to a back rest 820, in accordance with various embodiments. According to one set of embodiments, an X-shaped mount support frame 805 is provided. The mount support frame 805 includes an upper set of arms 810A and lower set of arms 810B (collectively "arms"). The arms 810A, 810B (collectively 810) are coupled to a backrest 820 via an upper adjuster 815A, and lower adjuster 815B (collectively "adjusters"). The adjusters 815 may couple to the seatback of the back rest 820 in various ways, including, without limitation, being screwed into the seatback, being bolted to the seat back, or attaching to an adapter separately installed on the seatback for attachment to mount support frame 805. In various embodiments, the adjusters 815 may be operable to extend and retract, pivot, rotate, and move to allow the mount support frame 805 to be coupled to various shapes, sizes, materials, and positions of backrests 820.

In a further set of embodiments, one or more straps 825 may be used to further secure the backrest 820 to the mount support frame 805. In various embodiments, the strap 825 may wrap around the entire backrest 820 of the chair and have tightening functionality to secure the backrest 820 against mount support frame 805. In some embodiments, the one or more straps 825 may be positioned to wrap around the backrest in a longitudinal orientation, while in other embodiments, the one or more straps 825 may be positioned to wrap around the backrest in a latitudinal orientation. In further embodiments, the one or more straps 825 may be arranged in an intersecting configuration where one or more straps 825 may intersect with one or more other straps 825, to form a matrix, grid, or lattice shape. In yet further embodiments, the one or more straps 825 may be a sleeve or sheath that may be tightened around the backrest 820. The one or more straps 825 may further include a quick release mechanism to disconnect from the back rest 820, mount support frame 805, or both. In another embodiment, the one or more straps 825 may also be tightened or loosened by controls of the adjusters 815.

Figure 9:
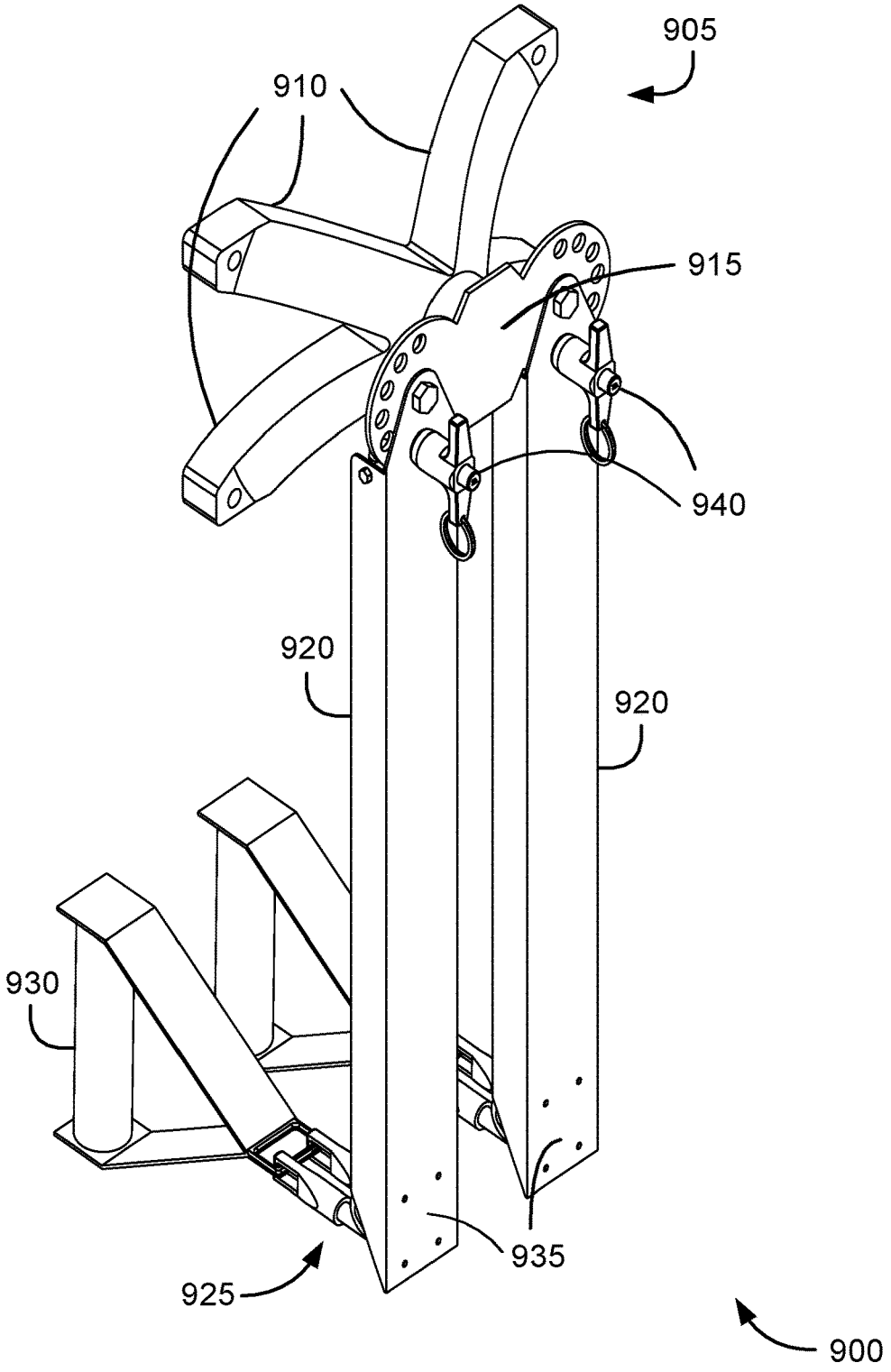
FIG. 9 is a perspective view of a seatback mountable chair workout machine, in accordance with various embodiments.

FIG. 9 is a perspective view of a seatback mountable chair workout machine 900, in accordance with various embodiments. According to a set of embodiments, the seatback mountable chair workout machine 900 includes a mount support frame 905. In various embodiments, the mount support frame 905 may be an X-shaped structure having one or more arms 910. Each of the arms 910 may include a set of respective arm attachment points at which the arms 910 may couple to a seatback or backrest.

A locking plate 915 may be mounted to a mounting hub of the mount support frame 905. In various embodiments, the locking plate 915 may be secured to the mounting hub via using fasteners, such as, without limitation, screws, bolts, welding, or other suitable methods of attachment. In other embodiments, the mounting hub may be part of the locking plate 915 to which mount support frame 905 may be coupled to the locking plate 915.

Rotatable arms 920 may be attached to respective pivot points of the locking plate 915 via locking mechanism 940. In various embodiments, the locking mechanism 940 may be a retractable spring plunger having a push button that may be depressed to retract a plunger from an extended position, or released to allow the plunger to extend from a retracted position. The locking mechanism may thus be used to lock or release the rotatable arms from a locking position of the locking plate 915.

In various embodiments, the rotatable arms 920 may include resistance bands 925 that extend from a proximal end of a respective rotatable arm 920 that is connected to the locking plate 915, to a distal end of the rotatable arm 920. The rotatable arms 920 may further include guiding pulleys at a distal end. In one set of embodiments, each guiding pulley may be secured to the rotatable arm 920 at a respective set of pulley attachment points 935. In various embodiments, the rotatable arms 920 may be strengthened or reinforced at pulley attachment points 935 or at points in the proximal end where an anchoring pin attaches to the rotatable arm 920, where a proximal end of resistance bands 925 may be secured to the rotatable arm 920 by the anchoring pin. In various embodiments, pulley attachment points 935 may be located on a back plate of the rotatable arm 920. In other embodiments, the pulley attachment points 935 may be located on any one or combination of structures of the rotatable arm, such as the side plates, front plate, back plate, or end plate. An end plate may include, for example, a cap joining at least two of either of the side plates, front plate, and back plate of a rotatable arm 920. A user attachment 930 may further be coupled to a distal end of the resistance bands 925.

Figure 10:
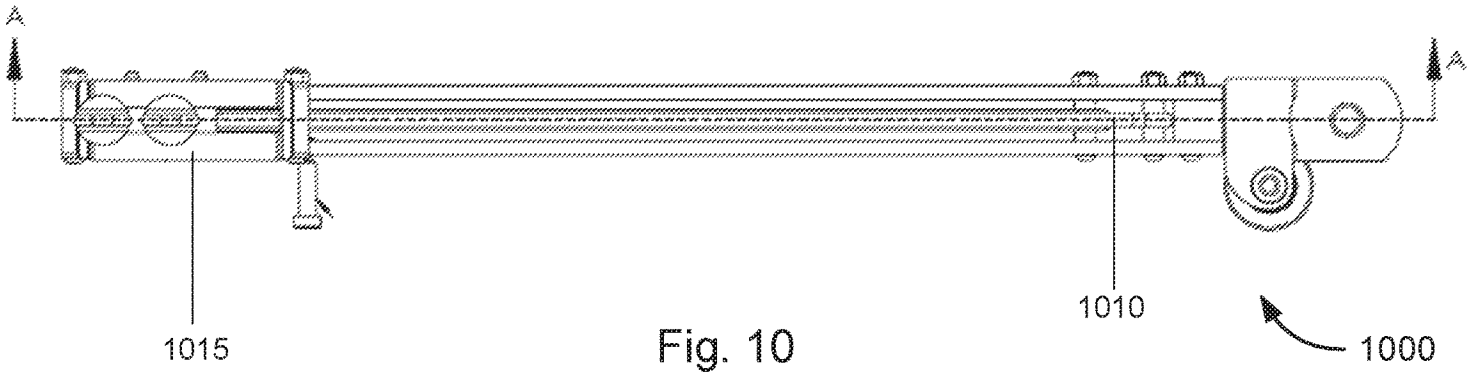
FIG. 10 is a front view of an arm of the clamp-supported chair workout machine and/or the seatback mountable chair workout machine, in accordance with various embodiments.
Figure 11:
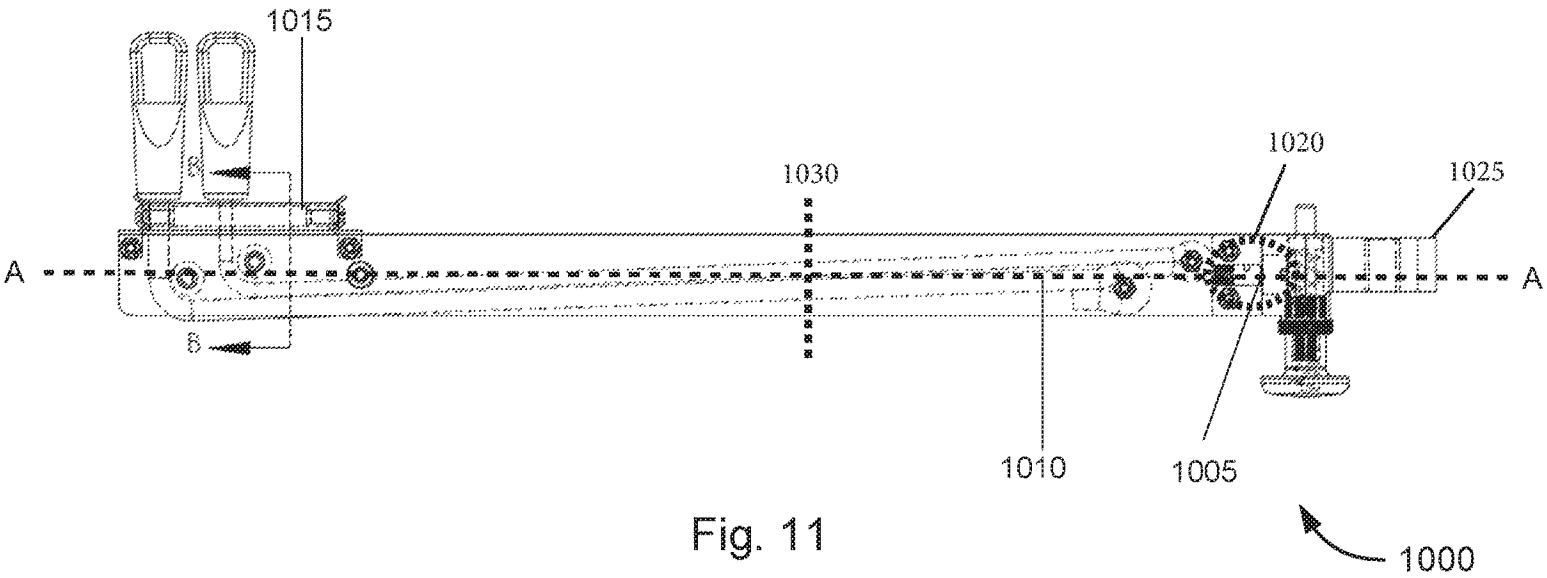
FIG. 11 is a section view of an arm of the clamp-supported chair workout machine and/or seatback mountable chair workout machine, in accordance with various embodiments.
Figure 12:
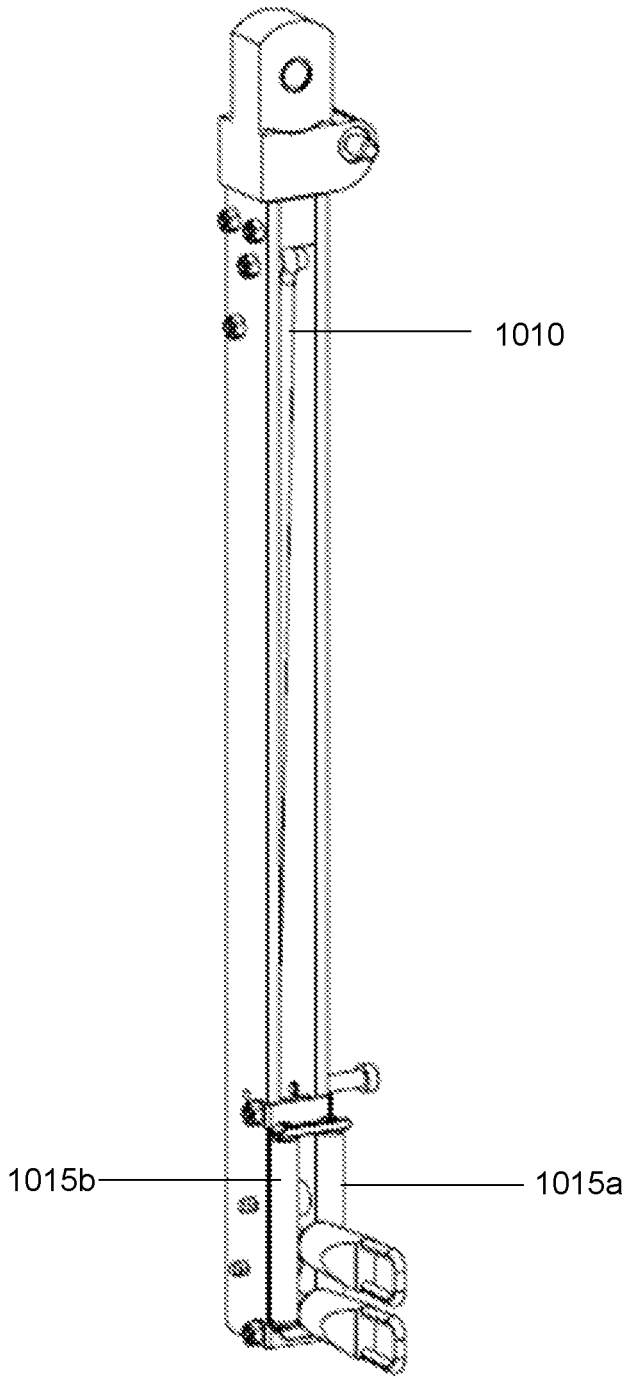
FIG. 12 is a perspective view of an arm of the clamp-supported chair workout machine and/or seatback mountable chair workout machine, in accordance with various embodiments.

In some embodiments, the arms of the workout apparatus might have a swivel function to provide enhanced versatility in the exercises accommodated by the apparatus. For instance, a rotatable arm (e.g., as described above) might include functionality to rotate axially, enabling the resistance bands to be stretched in different directions (such as in a frontward direction from the perspective of a person sitting in the chair, in a downward direction from the same perspective, in an upward direction from the same perspective, and/or at any angle between these directions). In some embodiments, the workout apparatus may have at least one rotatable arm 1000. In various embodiments, e.g., as described above, such a rotatable arm 1000 may be operable to rotate around, and lock into different locking positions respectively along either side of a locking plate. Merely by way of example, FIGS. 10-12 illustrate various views of a rotatable arm 1000 that can be implemented with any of the workout apparatus described herein. The skilled reader should understand that, while not illustrated on FIGS. 10-12 for the sake of simplicity, the rotatable arm 1000 can be attached to a locking plate of such an apparatus (or any other attachment point), as described in detail above.

Turning to the figures, FIG. 10 provides a front view of one embodiment of a rotatable arm 1000 (which may correspond to rotatable arm 120 of FIG. 1, rotatable arm 220 of FIG. 2, rotatable arm 320 of FIG. 3, rotatable arm 420 of FIG. 4, rotatable arm 520 of FIG. 5, rotatable arm 620 of FIG. 6, rotatable arm 720 of FIG. 7, rotatable arm 820 of FIG. 8, rotatable arm 920 of FIG. 9, and/or the like) of the clamp-supported chair workout machine and/or the seatback mountable chair workout machine, in accordance with various embodiments. FIG. 11 is a section view of an embodiment of the arm 1000 of the clamp-supported chair workout machine and/or the seatback mountable chair workout machine, in accordance with various embodiments. FIG. 12 is a perspective view of an embodiment of the arm 1000 of the clamp-supported chair workout machine and/or the seatback mountable chair workout machine, in accordance with various embodiments.

Additionally and/or alternatively, rotatable arm 1000 may include a rotatable attachment (shown within dashed circle 1020) and be operable to rotate axially around a pivot point 1005 (shown in FIG. 11) and/or longitudinal axis A-A (shown in FIG. 11). The rotatable attachment including pivot point 1005 may be located in rotatable arm 1000. The rotatable attachment including pivot point 1005 may be located near a top portion of rotatable arm 1000 (e.g., near the proximal end 1025 as described above, between a middle 1030 of the rotatable arm 1000 and the proximal end 1025 of the rotatable arm 1000, etc.) such that all (or substantially all) of rotatable arm 1000 rotates about pivot point 1005 and/or axis A-A. Alternatively and/or additionally, the rotatable attachment including pivot point 1005 might be located elsewhere on the arm 1000. In one aspect, the rotatable attachment including pivot point 1005 can be located anywhere on the arm 1000 that allows at least a portion of the arm 1000 to rotate without binding the resistance bands. The rotatable attachment including the pivot point 1005 may be provided by at least one of a cam follower bearing, a roller bearing, a thrust bearing between two washers, a solid sleeve bearing, and/or the like.

A tensile force on one or more resistance elements 1010 (such as the resistance bands described above) may cause all (or substantially all) of the rotatable arm 1000 to rotate axially about pivot point 1005 and/or axis A-A. (Alternatively and/or additionally, a directly-applied axial torque on the arm 1000 itself can cause similar rotation.) By allowing rotatable arm 1000 rotate about a pivot point 1005 and/or axis A-A, all (or substantially all) of the rotatable arm 1000 may rotate to different positions to support each type of exercise the user of the supported chair workout machine and/or the seatback mountable chair workout machine is performing. In some cases, the pivot point 1005 can provide free rotation, which can allow the arm 1000 to naturally rotate into an optimal position for a particular exercise being performed.

In another set of embodiments, rotatable arm 1000 might further comprise one or more anti-friction devices, such as roller tubes 1015*a* and 1015*b* (collectively roller tubes 1015) to name one example. The roller tubes 1015 might be located near a bottom portion of the rotatable arm 1000. A first roller tube 1015*a* can be disposed on a first side of rotatable arm 1000 and a second roller tube 1015*b* may be disposed on a second side (opposite to roller tube 1015*a*) of rotatable arm 1000. The space between the one or more roller tubes 1015 may act as a frictionless guide or near frictionless guide for the one or more resistance elements 1010. The one or more roller tubes 1015 may rotate as the resistance elements 1010 extend and retract between the tubes 1015, helping to prevent any friction or binding between the arm 1000 and the resistance elements 1010 as the resistance elements 1010 extend and retract.

Thus, the one or more roller tubes 1015 can act to prevent the resistance elements 1010 from rubbing against the side of the arm 1000, reducing the wear and tear of the resistance elements 1010 and/or providing a more satisfying workout experience. Additionally, the one or more roller tubes 1015 may prevent the one or more resistance elements 1010 from retracting back into the arm 1000 after the clamp-supported chair workout machine and/or the seatback mountable chair workout machine is used.

In additional embodiments, all or substantially all of the support frame of the workout apparatus might have functionality to flex backwards (away from the chair to which the apparatus is attached), deflecting with the reclining of a backrest of the attached furniture so that it does not impair normal operating functions of the furniture. Merely by way of example, FIG. 13 provides a side view of a clamp-supported chair workout machine 1300, in accordance with various embodiments.

The clamp-supported chair workout machine 1300 might comprise an L-shaped main support frame 1305 which has a vertical member and transverse member. The support frame 1305 may be coupled to clamp 1310 at a distal end of the transverse member. Clamp 1310 may be configured to attach to a structure of an office chair such as a seat post.

Figure 13:
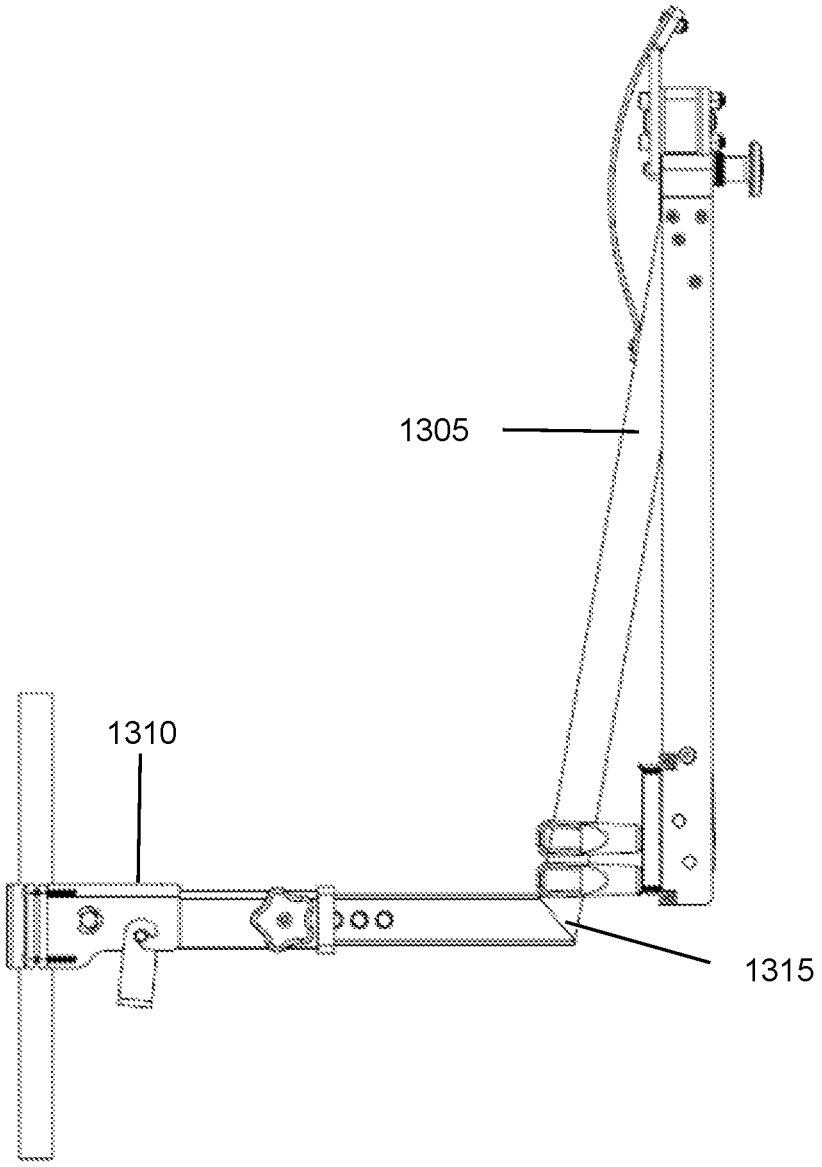
FIG. 13 is a side view of a clamp-supported chair workout machine, in accordance with various embodiments.

The main support frame 1305 may further include a spring loaded hinge 1315 having an internal spring (not shown in FIG. 13). The spring may allow the vertical member of the main support frame 1305 to flex backwards, deflecting with the reclining of a backrest of the attached furniture so that it does not impair normal operating functions of the furniture, and to return to an original position when the backrest returns. Alternative techniques may be used to allow the vertical member to flex backwards at hinge 1315, including, without limitation, using tension bars, or hydraulic or pneumatic pistons within the vertical member of the main support frame 1305.

Additionally and/or alternatively, all or substantially all of the support frame 1305 of the supported chair workout machine 1300 might have functionality to flex backwards. Clamp 1310 may be configured to allow all or substantially all of the support frame 1305 (including both the vertical member and transverse member) to flex backwards, deflecting with the reclining of a backrest of the attached furniture so that it does not impair normal operating functions of the furniture. The support frame 1305 may be rigid or include a spring loaded hinge that further allows the vertical member of the main support frame 1305 to flex backwards. A spring may be disposed in clamp 1310 to allow all or substantially all of the support frame 1305 (including both the vertical member and transverse member) to flex backwards. Alternative techniques may be used to allow the support frame 1305 to flex backwards at clamp 1310, including, without limitation, using tension bars or hydraulic or pneumatic pistons within clamp 1310. Additionally and/or alternatively, clamp 1310 may prevent/restrict the support frame 1310 from flexing forwards toward a backrest of the attached furniture.

While certain features and aspects have been described with respect to exemplary embodiments, one skilled in the art will recognize that numerous modifications are possible. For example, the methods and processes described herein may be implemented using the variously described hardware components and any combination thereof. Further, while various methods and processes described herein may be described with respect to particular structural and/or functional components for ease of description, methods provided by various embodiments are not limited to any particular structural and/or functional architecture but instead can be implemented on any suitable hardware. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A workout system configured to be attached to an office chair, the workout system comprising:

an attachment mechanism that is configured to attach to at least one structure of the office chair;

a support frame coupled to the attachment mechanism;

at least one rotatable arm comprising a proximal end attached to the support frame and a rotatable attachment, wherein the rotatable attachment is located between a middle of the rotatable arm and the proximal end of the rotatable arm, and wherein the rotatable attachment enables at least one portion the at least one rotatable arm to rotate about a longitudinal axis extending along a length of the rotatable arm; and one or more resistance elements coupled to the at least one rotatable arm, the resistance elements arranged to provide resistance to movement.

2. The workout system of claim 1, wherein the at least one structure is a backrest of the office chair.

3. The workout system of claim 2, wherein the support frame comprises a mounting support frame, wherein the mounting support frame is coupled to a seatback of the backrest of the office chair at an at least one attachment point of the support frame.

4. The workout system of claim 1, wherein the at least one structure is a seat post of the office chair.

5. The workout system of claim 4, wherein the support frame comprises at least one transverse member having a distal and proximal end, the distal end of the at least one transverse member having a clamp, the clamp coupling the support frame to the seat post of the office chair.

6. The workout system of claim 1, wherein the support frame further comprises a locking plate having at least one set of locking positions for a respective at least one rotatable arm.

7. The workout system of claim 6, wherein the at least one rotatable arm is attached to a pivot point of the locking plate, wherein the rotatable arm is operable to rotate around the pivot point.

8. The workout system of claim 6, wherein the locking plate includes a locking mechanism to lock the at least one rotatable arm to a locking position of the at least one set of locking positions.

9. The workout system of claim 8, wherein the locking plate comprises two pivot plates, wherein one rotatable arm is attached to each of the two pivot plates, wherein each rotatable arm is operable to rotate around the pivot point of a corresponding pivot plate.

10. The workout system of claim 1, wherein the one or more resistance elements comprise resistance bands extending along at least a portion of the at least one rotatable arm.

11. The workout system of claim 1 further comprising at least one user attachment disposed at a distal end of the at least one rotatable arm and operably coupled to the one or more resistance elements.

12. The workout system of claim 1 further comprising one or more guiding pulleys, wherein the guiding pulleys interact with the one or more resistance elements to guide movement of the one or more resistance elements.

13. The workout system of claim 1, wherein application of force to the one or more resistance elements causes the at least one portion of the rotatable arm to rotate about the longitudinal axis of the rotatable arm.

14. The workout system of claim 1, further comprising one or more roller tubes attached to the rotatable arm, wherein the one or more roller tubes interact with the one or more resistance elements to guide movement of the one or more resistance elements.

15. The workout system of claim 1, wherein the attachment mechanism is configured to allow at least a portion of the support frame to flex backward away from the at least one structure of the office chair.

16. The workout system of claim 1, further comprising:

a joint connecting a first portion of the support frame to a second portion of the support frame, the joint being configured to allow a first portion of the support frame to flex backward, away from a seat post of the office chair.

17. A method, comprising:

providing an attachment mechanism that is configured to attach to at least one structure of an office chair;

providing a support frame coupled to the attachment mechanism;

securing the support frame to the at least one structure of the office chair;

providing at least one rotatable arm comprising a proximal end attached to the support frame and a rotatable attachment, wherein the rotatable attachment is located between a middle of the rotatable arm and the proximal end of the rotatable arm, and wherein the rotatable attachment enables at least one portion of the at least one rotatable arm to rotate about a longitudinal axis extending along a length of the rotatable arm;

providing one or more resistance elements coupled to the at least one rotatable arm; and rotating the one or more rotatable arms about a pivot point of the support frame into a position that the one or more resistance elements resist movement by a user.

18. The method of claim 17, wherein the attachment mechanism is configured to allow at least a portion of the support frame to flex backward away from the at least one structure of the office chair.

* * * * *